US011744341B2

(12) United States Patent
Gooris

(10) Patent No.: US 11,744,341 B2
(45) Date of Patent: Sep. 5, 2023

(54) RETRACTABLE AND EXTENDABLE LOADBEARING HANDLE AND LUGGAGE SYSTEM

(71) Applicant: Frederic Frans Petrus Gooris, Hong Kong (HK)

(72) Inventor: Frederic Frans Petrus Gooris, Hong Kong (HK)

( * ) Notice: Subject to any disclaimer, the term of this patent is extended or adjusted under 35 U.S.C. 154(b) by 2 days.

(21) Appl. No.: 17/614,546

(22) PCT Filed: Mar. 15, 2021

(86) PCT No.: PCT/CN2021/080733

§ 371 (c)(1),
(2) Date: Nov. 28, 2021

(87) PCT Pub. No.: WO2021/185199

PCT Pub. Date: Sep. 23, 2021

(65) Prior Publication Data

US 2022/0240639 A1 Aug. 4, 2022

Related U.S. Application Data

(60) Provisional application No. 62/990,421, filed on Mar. 16, 2020, provisional application No. 62/989,880, filed on Mar. 15, 2020.

(51) Int. Cl.

| | |
|---|---|
| ***A45C 13/26*** | (2006.01) |
| ***A45C 5/03*** | (2006.01) |
| ***A45C 13/02*** | (2006.01) |

(52) U.S. Cl.

CPC ..... *A45C 13/262* (2013.01); *A45C 5/03* (2013.01); *A45C 13/02* (2013.01); *A45C 2013/267* (2013.01)

(58) Field of Classification Search

CPC ..... A45C 13/262; A45C 5/03; A45C 13/02; A45C 2013/267

See application file for complete search history.

(56) References Cited

U.S. PATENT DOCUMENTS 923,807 A * 6/1909 Bonsall ..... A47B 61/06 190/13 C
3,869,034 A * 3/1975 Thornton, Jr. ..... A47B 61/06 190/31

(Continued)

FOREIGN PATENT DOCUMENTS

CN 206534263 U 10/2017
CN 206659365 U 11/2017

(Continued)

OTHER PUBLICATIONS

First Office Action of corresponding China patent application No. 202180003225.0 dated Sep. 26, 2022.

*Primary Examiner* — Tri M Mai

(74) *Attorney, Agent, or Firm* — Idea Intellectual Limited; Margaret A. Burke; Sam T. Yip

(57) ABSTRACT

In accordance with one aspect of the present invention, there is provided a handle structure for a container or folding structure including a handle with an actuator, a movable retaining pin, an extendable and retractable arm and a handle seat which is or cooperates with a structural part of the container and with a recess. The retaining pin is retracted within the handle by a fastening member. The fastening member includes a pin locking magnet for cooperating with a recess locking magnet in the recess; and a pin retracting magnet for cooperating with handle retracting magnet. The container may be a suitcase, toolbox or other container with extendable and retractable arms/handles. Other embodiments employ springs to urge the retaining pin towards the recess in the handle seat.

18 Claims, 11 Drawing Sheets

(56) References Cited

U.S. PATENT DOCUMENTS

| | | | | |
|---|---|---|---|---|
| 4,759,431 | A | 7/1988 | King et al. | |
| 5,253,739 | A | 10/1993 | King | |
| 5,575,362 | A | 11/1996 | Franklin et al. | |
| 5,639,521 | A | 6/1997 | Fraus et al. | |
| 5,924,169 | A * | 7/1999 | Lu | A45C 13/22 190/115 |
| 6,047,442 | A | 4/2000 | Workman | |
| 6,079,527 | A * | 6/2000 | Kuo | A45C 13/262 280/37 |
| 6,357,566 | B1 | 3/2002 | Pond | |
| 7,097,181 | B2 * | 8/2006 | Sadow | A45C 13/262 280/37 |
| 7,779,976 | B2 * | 8/2010 | Mangano | A45C 13/02 190/110 |
| 7,854,321 | B2 | 12/2010 | Twig et al. | |
| 7,874,408 | B2 * | 1/2011 | Suppancig | A45C 13/262 190/115 |
| 8,474,098 | B1 | 7/2013 | Yang | |
| 2005/0126872 | A1 | 6/2005 | Dror | |
| 2007/0187202 | A1 | 8/2007 | Wu | |
| 2010/0276241 | A1 | 11/2010 | Malone | |
| 2013/0220754 | A1 * | 8/2013 | Guidry | A45C 13/28 190/18 A |
| 2016/0206068 | A1 | 7/2016 | Tsai | |

FOREIGN PATENT DOCUMENTS

| | | | |
|---|---|---|---|
| CN | 109497672 | A | 3/2019 |
| CN | 209950585 | U | 1/2020 |
| JP | 2018134531 | A | 8/2018 |

* cited by examiner

RETRACTABLE AND EXTENDABLE LOADBEARING HANDLE AND LUGGAGE SYSTEM

FIELD OF THE INVENTION

The present invention relates to a retractable and extendable loadbearing handle for a container or foldable structure and to a luggage system that may use the retractable and extendable loadbearing handle.

DESCRIPTION OF THE RELATED ART

Conventional rolling containers such as luggage, toolboxes, or equipment cases, typically feature an extendable handle that comfortably reaches the extended arm of the user in order that the luggage may be pulled behind or alongside the user. However, conventional containers with retractable handles require a second, fixed handle when lifting the container. If a user improperly lifts a loaded suitcase or other container with the retractable handle in its extended position, the forces exerted on the mechanisms to regulate the extension largely exceed the forces they were design to withstand, easily resulting in permanent damage to the regulating mechanisms. Additionally, the arms of the extendable handle may become bent or warped due to the load. In this state, the arms can no longer be retracted and the suitcase or other container is no longer usable. Thus, there is a need in the art for improved extending and retracting handle that can support the load of a packed container such as a suitcase, toolbox, or equipment case or, alternatively, as a handle for engaging and releasing foldable structures.

In other aspects, conventional containers such as luggage or other cases, are typically shells that protects the contents while traveling, but are impractical to access the contents when the user arrives at his/her place of stay; the user often does not want to unpack all the clothes into a closet or chest of drawers. For example, there may be no clothing storage at the user's destination or, for practical reasons, as he/she does not want spread belongings around, due to time constraints, or hygiene concerns. There are two major issues. First, the clothes within a suitcase are stacked on top of each other making the underlying layers harder to access without causing disarray to the overlying layers. Second, with each passing day the user generates dirty laundry that cannot be mixed with the clean clothes. Thus, there is a need in the art for a system that enables the user to rapidly unpack, easily access his clothes, and maintain separation from dirty laundry, all confined within the space of the luggage.

Prior attempts have been made to provide a temporary clothing storage system inside luggage. For example, US 2010/0276241 describes a hanging shelf system travel organizer that is used with a suitcase. In this system, an accordion-like set of clothing compartments is manually unfolded from the suitcase; the system includes hangers to hang it within a closet. Alternatively, rigid elements are provided as a support frame. In US 2005/0126872, a collapsible compartmentalized structure is placed within a suitcase. In order to be freestanding, a rigid frame is required to be carried within the suitcase to support the structure. Thus, the prior art solutions rely on external supports (such as the rack within a closet on which to hang the system) or require the user to carry within the suitcase bulky frames on which to attach the clothing storage systems. The extra weight and space that these frame members require is unacceptable to most travelers.

SUMMARY OF THE INVENTION

In one aspect, the present invention provides a handle structure for a container that includes a handle with an actuator and a movable retaining pin. An extendable and retractable arm connects to the handle. A handle seat is integrated with the container and forms a structural part of the container. The handle seat includes a hollow recess. The retaining pin is retracted within the handle by a fastening member.

The fastening member includes a pin locking magnet for cooperating with a recess locking magnet in the recess. A pin retracting magnet cooperates with a handle retracting magnet. The handle structure is configured such that the handle in a retracted position has the retaining pin and the recess aligned. The pin locking magnet is configured to be attracted to the locking magnet. The attraction between the pin locking magnet and locking magnet is stronger than the attraction between the pin retracting magnet and the handle retracting magnet such that the retaining pin automatically move outwards into the recess to lock the handle to the handle seat in order to obstruct any extracting movement of the handle and to transfer the loadbearing forces from the handle to the handle seat or other structural element of the container.

The container may be a suitcase, a toolbox, an electronics case, or any other receptable that may hold items and may be carried with an extendable handle/handle arms.

In another aspect, a handle structure for a container may include a handle with a first actuator and a movable retaining pin positioned within the handle. An extendable and retractable arm is connected to the handle. A handle seat is integrated with and forms a structural part of a container. The handle seat includes a recess for receiving the movable retaining pin. That is, the moveable retaining pin is movable between a position within the handle and a position within the recess to lock the handle in a load-bearing position. The handle structure is configured such that when the handle is in a retracted position, the retaining pin and the recess are aligned. A second actuator cooperates with the first actuator to move the retaining pin from the position within the handle to the position within the recess and to retract the retaining pin from the position within the recess to the position within the handle. This permits the handle to extend via the extendable and retractable arm connected to the handle. The second actuator may be one or more springs to urge the movable retaining pin towards the recess.

DETAILED DESCRIPTION

Numerous types of rolling containers with extendable handles are known in the art including full-sized suitcases, garment bags, toolboxes, electronics cases, and carry-on luggage. Examples of rolling luggage with extending handles for pushing or pulling the luggage are shown in U.S. Pat. Nos. 4,759,431, 5,253,739, 5,575,362, and 5,639,521, the disclosures of which are incorporated herein by reference. Other rolling containers with extending and retracting handles are also known, including electronics cases, musical instrument cases, tool boxes, etc. An example of a tool box with an extendable handle is depicted in U.S. Pat. No. 7,854,321 the disclosure of which is incorporated by reference herein.

The present invention solves the disadvantage of the conventional extendable and retractable handle by creating an extendable and retractable handle configured to bear the load of the container being towed, pushed, or carried. The handle of the present invention is suitable for use in any kind of container, luggage, case, or enclosure, such as the ones described above but not limited thereto.

Figure 1:
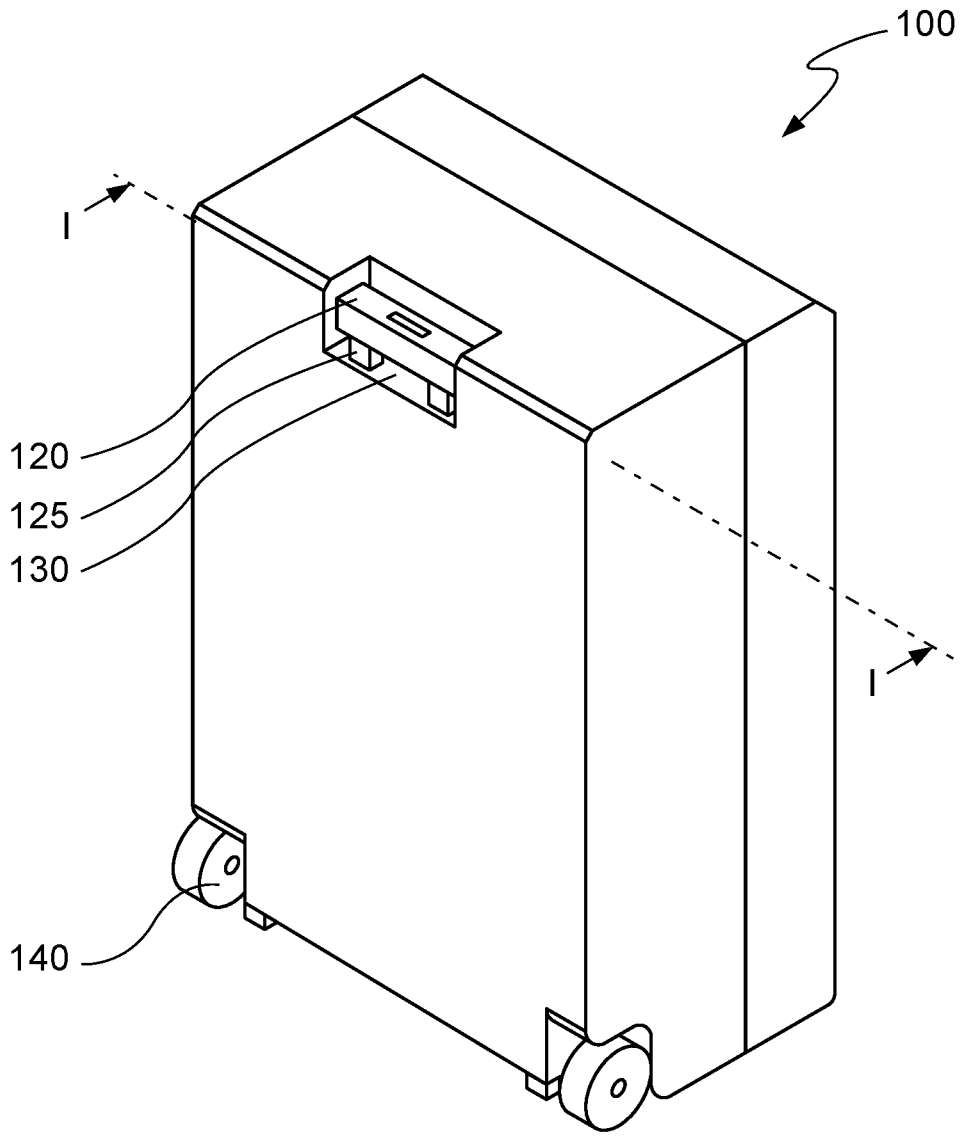
FIG. 1 is a perspective view of a container with a retractable handle according to an embodiment.
Figure 2:
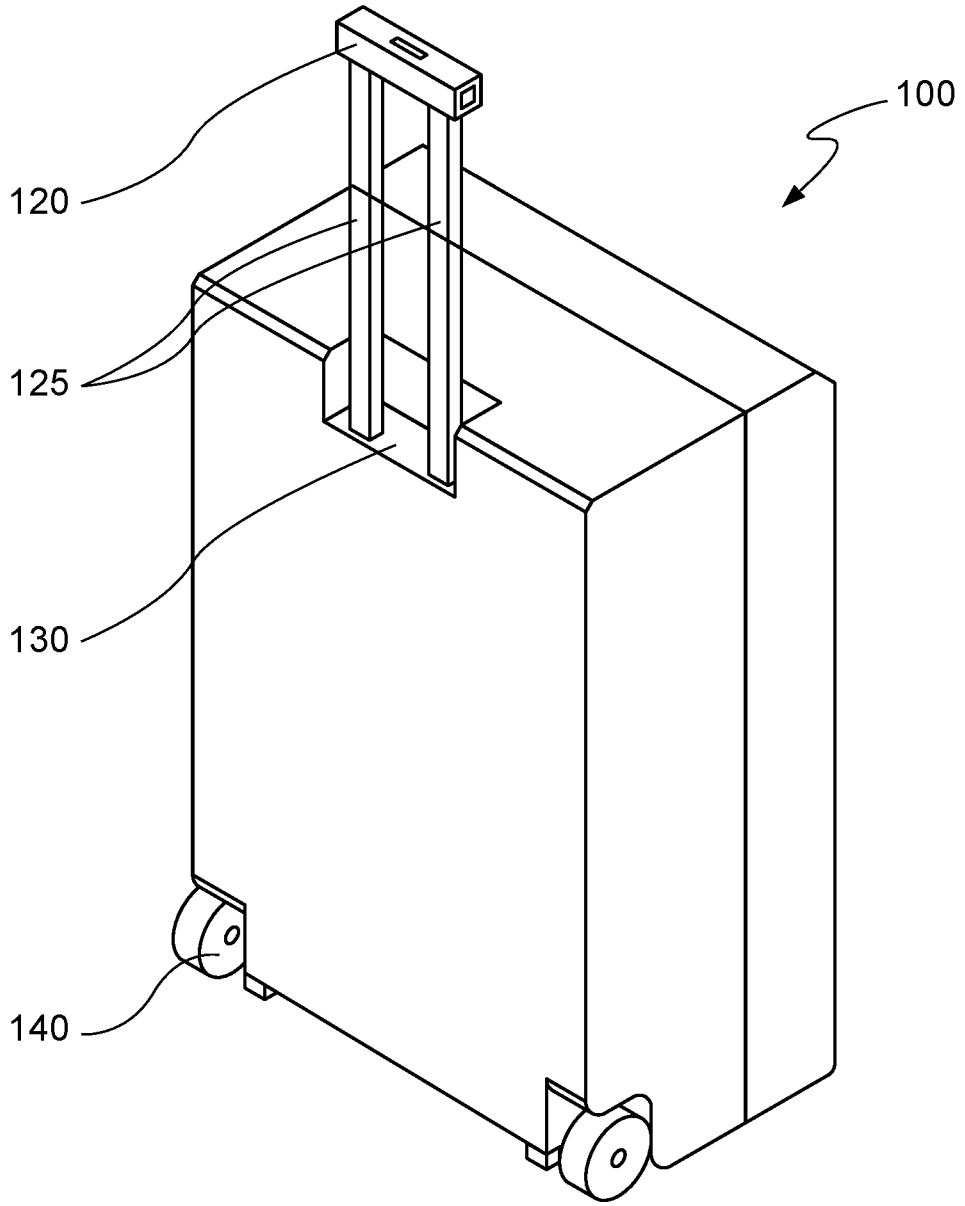
FIG. 2 is the container of FIG. 1 with the handle in an extended position.

FIG. 1 depicts a container 100 with an extendable and retractable handle 120. In FIG. 1 the handle is in the retracted position; it is extendable via arms 125 from a handle seat 130. As seen in FIG. 1, the container 100 may optionally include wheels 140 for propelling the suitcase, although wheels are not required for the container 100. FIG. 2 depicts the handle 120 in an extended position via arms 125. In some embodiments, the arms 125 may be telescoping arms using concentric tubes, typically having a circular, square, or rectangular cross-section.

Figure 3:
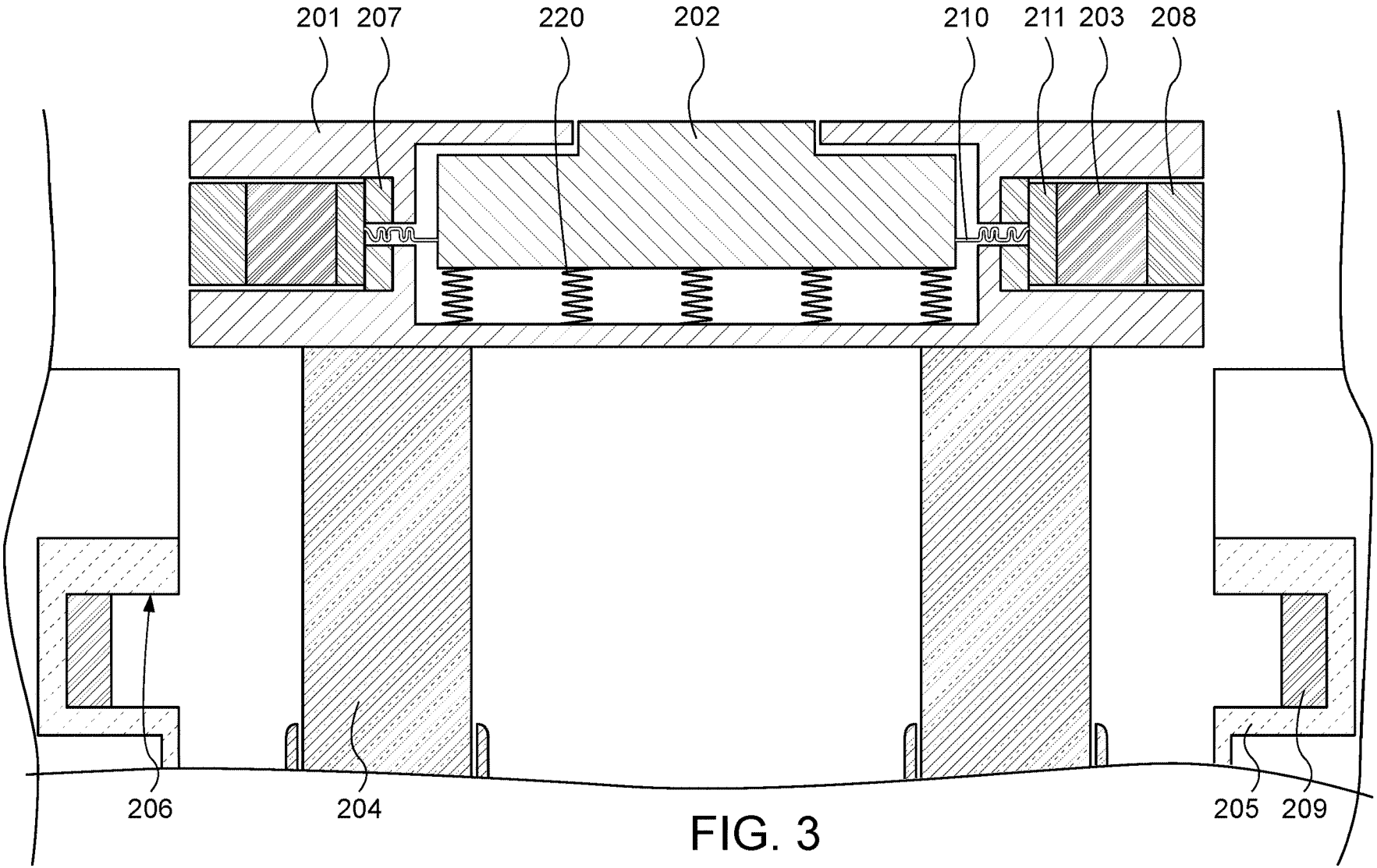
FIG. 3 is a cross-sectional view of a retractable handle in the extended position with retaining pins positioned within the handle in accordance with an embodiment of the present invention.

FIG. 3 depicts a cross section of a handle structure 200 that can lock the handle 201 to structural elements of the container such that the handle becomes load-bearing and the entire container can be lifted by the handle without damaging the handle or any extending/telescoping arms. The handle includes an actuator 202 which, as seen in FIG. 3, may be in the form of a push-button that includes one or more springs 220 for returning the push button to an initial, non-actuated state. Two movable retaining members 203 are positioned within the handle and may be pins, bolts, fasteners or other movable retaining elements that can pass from the handle into recesses 206 positioned within a handle seat 205 or any frame or bracket that makes a connection with a structural element of the container for transferring a load from the handle to the container structure itself. The handle structure is connected to extendable and retractable arms 204 such that the handle 201 may be extended or retracted on the arms 204. The extendable and retractable arms 204 may include telescoping members, for example cylindrical or rectangular tubes that telescope within each other in order to shorten the length that is stored within the bag, luggage, or container to which the handle is attached.

Note that although two sets of elements are shown (pins, arms, recesses, magnets, etc.) it is understood that one or more than two sets of elements may be used depending upon the desired strength of the handle, the size of the container, and the nature of the contents to be carried within the container.

FIG. 3 depicts the extendable and retractable handle 201 in an extended position. In the extended position, two retaining pins 203 are retracted within the handle 201 by any known retaining or fastening members such as magnets, hook and loop fasters (e.g., VELCRO), screws, or the like. In the example of FIG. 3, a retaining pin includes a pair of magnets: a pin locking magnet 208 for cooperating with a recess locking magnet 209 in the recess 206 and a pin retracting magnet 211 for cooperating with a handle retracting magnet 207, positioned within the handle. In FIG. 3, the handle retracting magnet 207 has magnetically attracted the pin retracting magnet 211 such that the pin is securely held within the handle with the handle in an extended position.

Figure 4:
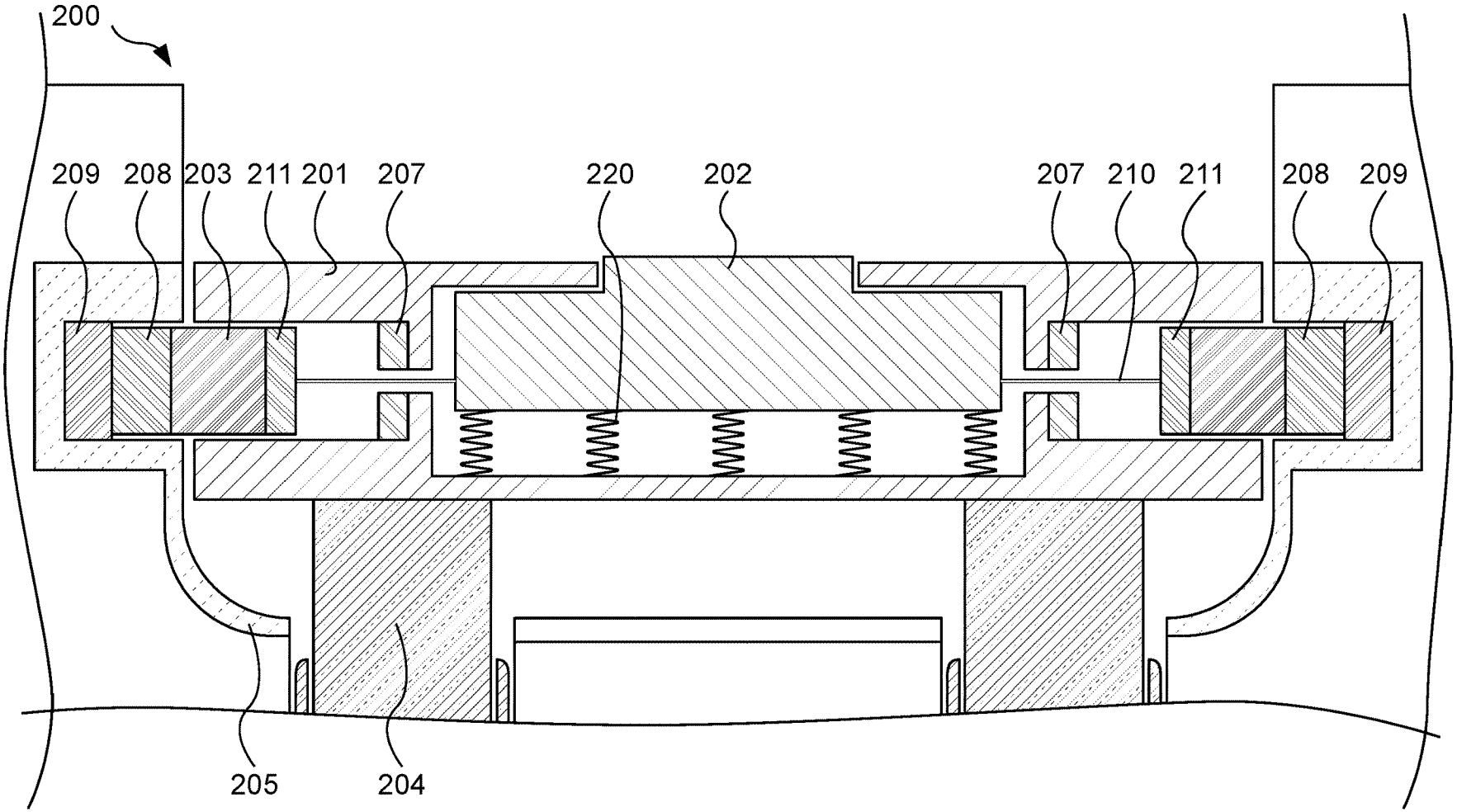
FIG. 4 is a cross-sectional view of a retractable handle in the retracted and locked position with the retaining pins in seated within the recesses in accordance with an embodiment of the present invention.

When the handle 201 is fully retracted, shown in FIG. 4, the retaining pins 203 and the recesses 206 are aligned. The pin locking magnet 208 is drawn to locking magnet 209. That is, the attraction between magnets 208 and 209 may be stronger than the attraction between the pin retracting magnet 211 and the handle retracting magnet 207. Based on this attraction, the retaining pins 203 automatically move outwards into the recesses 206 solidly locking or engaging the handle 201 to the handle seat 205 (or any other structural element of the container) obstructing any extracting movement of the handle. The retaining pins 203 transfer the loadbearing forces from the handle 201 to the handle seat 205 which is a structural part of the container or is attached to a structural part of the container. That is, the recesses 206 and handle seat 205 may be part of a suitcase or case frame or any other structure that distributes the load to structural elements of a case to be lifted by handle 201.

Thus, in operation, the attraction between the pin locking magnet 208 and recess locking magnet 209 is configured to be stronger than the attraction between the pin retracting magnet 211 and the handle retracting magnet 207 such that the retaining pin 203 is configured to automatically move into the recesses 206. This unites the handle 201 with the handle seat 205 to obstruct any extracting movement of the handle and to transfer the loadbearing forces from the handle 201 to the handle seat 205.

Figure 5:
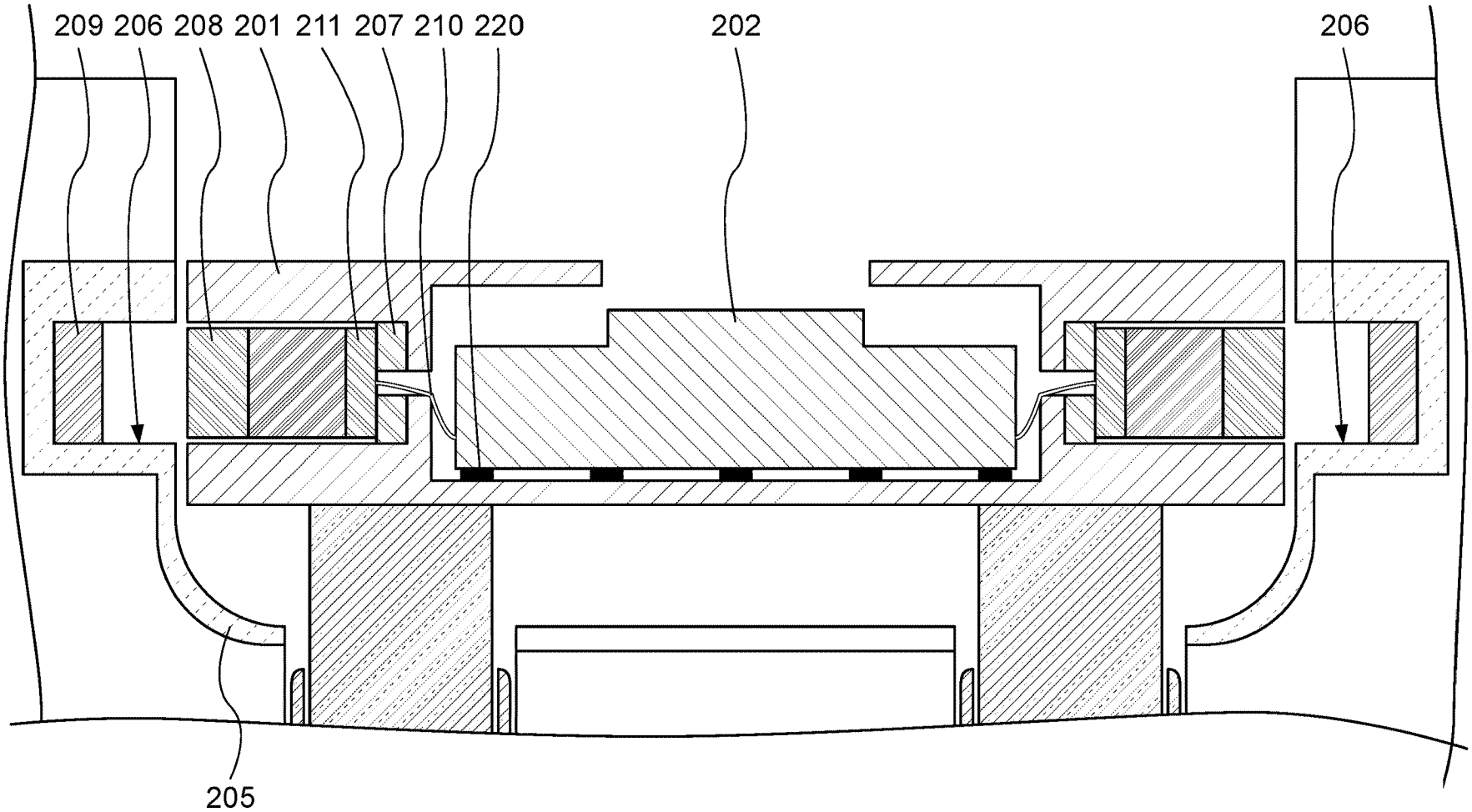
FIG. 5 is a cross-sectional view of a retractable handle in the retracted position with the retaining pins positioned within the handle during actuation in accordance with an embodiment of the present invention.

In order to extend the handle 201, the user retracts retaining pins 203 from the recesses 206 into the interior of handle 201. As seen in FIG. 5, when the actuator 202 is pressed, it retracts the retaining pins 203 back into the handle 201, for example, by means of cables 210 or any other structure that pulls the retaining pins 203 towards the handle retaining magnets 207. Once the retaining pins 203 are retracted within handle 201 and locked to magnets 207, the user can extend the handle 201/arms 204 since the handle 201 will clear the recesses 206, allowing the entire assembly to move freely out from the handle seat 205.

While two pins 203 are depicted in the FIGS., it is understood that a single pin or more than two pins may be used. Other locking members may also be used, besides pins. For example, latches may be used with an interlocking member in the recess with the actuator in the handle releasing the latch. A push button actuator in the handle may connect to cables to release a latch element from a connection in the recessed portion. Conventional commercially-available latches may be used. In short, any mechanism for locking the handle in position may be used to accomplish the objectives of the present invention.

The handle of the present invention may be incorporated into any of the luggage and cases depicted in the patents cited above and also in any other device that uses extendable handles and is configured to be load-bearing. In this way, only a single handle is needed for both rolling the container and for carrying the container, eliminating the problems of extending handle misuse for load-bearing applications.

Figure 6:
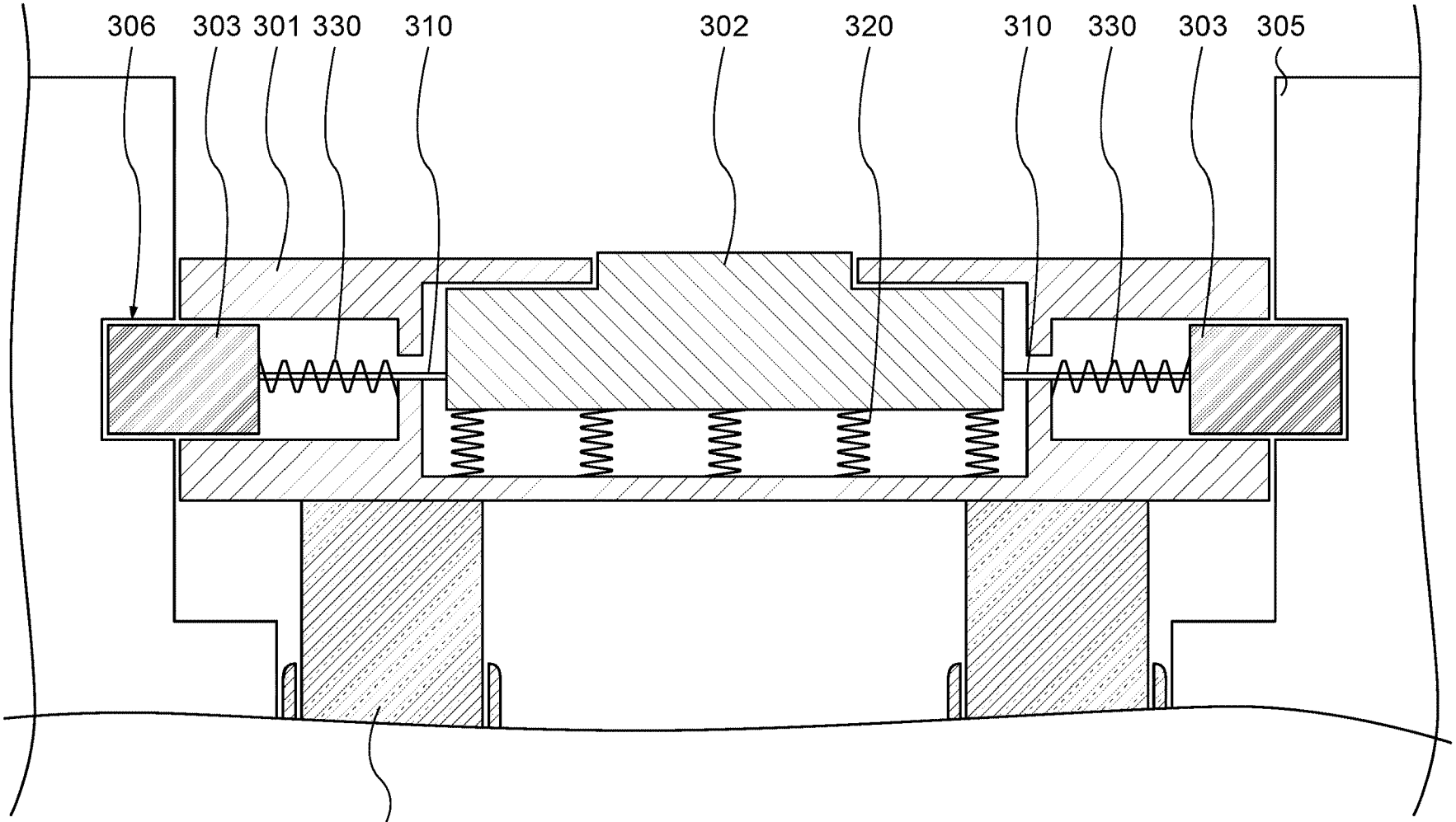
FIG. 6 is a cross-sectional view of a retractable handle in the retracted position with springs urging a retaining pin into a recess according to a further embodiment.

Turning to FIG. 6, another aspect of the present invention is depicted. In FIG. 6, springs are used to actuate the retaining pins with retracting cables used to withdraw the retaining pins within the handle. When the handle 301 is fully retracted, shown in FIG. 6, retaining pins 303 and the recesses 306 are aligned. One or more actuators, here depicted as normally-open springs 330, urges the pins 303 into the recesses 306. Based on the spring force, the retaining pins 303 automatically move outwards into the recesses 306 solidly engaging the handle 301 to the handle seat 305 (or any other structural element of the container) obstructing any extracting movement of the handle. The retaining pins 303 transfer the loadbearing forces from the handle 301 to the handle seat 305 which is a structural part of the container or is attached to a structural part of the container. That is, the recesses 306 and handle seat 305 may be part of a suitcase or case frame or any other structure that distributes the load to structural elements of a case to be lifted by handle 301.

To retract the pins 303, shown in FIG. 6, the actuator 302 is depressed against the force of springs 320 and cables 310 or other withdrawal elements pull against the spring force from normally-open springs 330 to close the springs 330 and withdraw the pins 303 from recesses 306. The handle 301 may then be extended along arms 304 for pulling the container along optional wheels. With the springs 330 in a compressed, closed position, a latching element (not shown) may maintain the springs in the closed position so that pins 303 are retained within the handle 301 when the handle is in an extended state.

Figure 7:
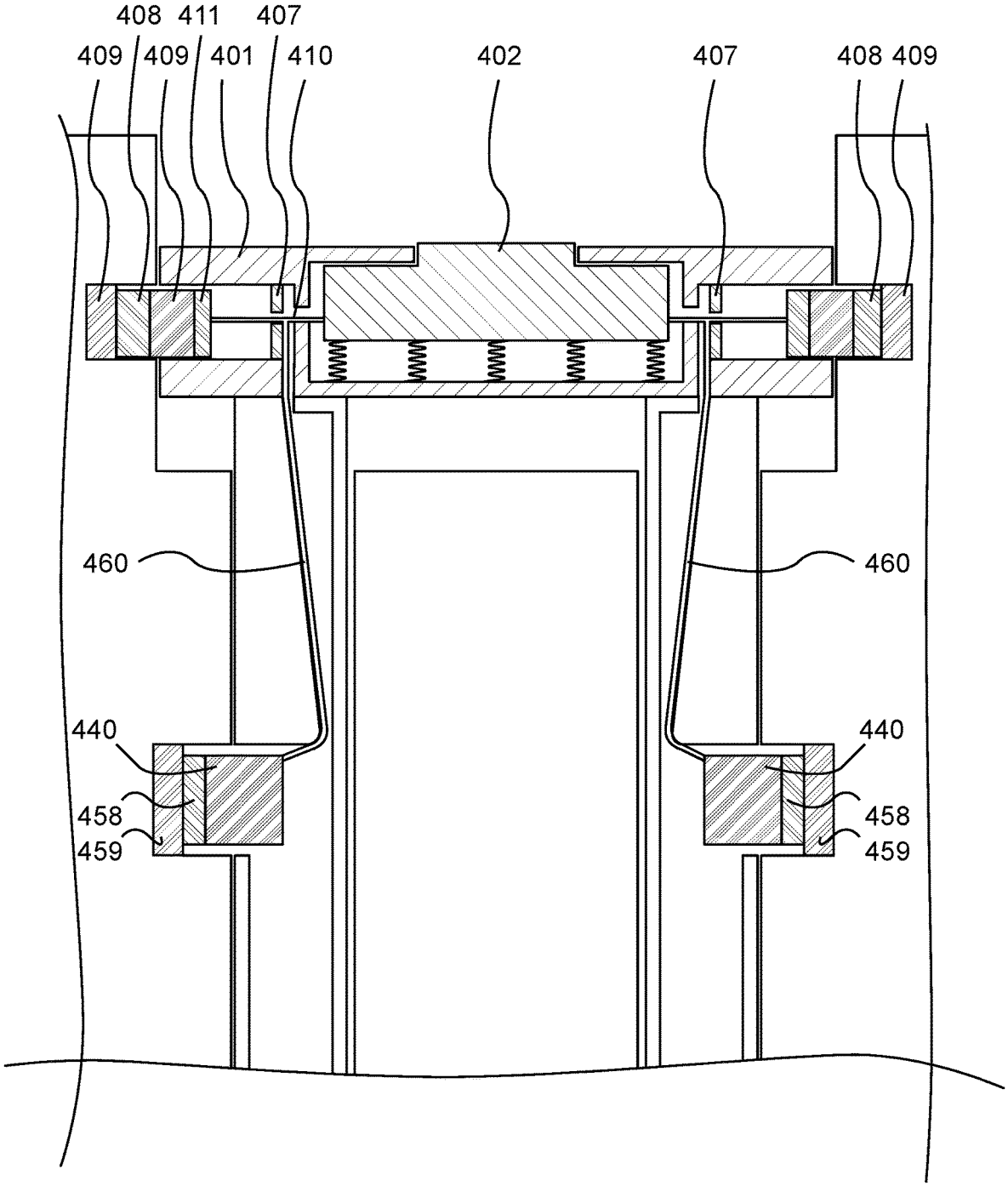
FIG. 7 is a cross-sectional view of a retractable handle with an additional retaining pin to lock the handle in an extended position.

The pins 203 or 303 of the above FIGS. may optionally be located in locations other than the handle when desiring to lock the luggage handle in an extended position. FIG. 7 schematically depicts an option in which two sets of pins 403 and 440 are provided to give the user an option to lock the handle in a retracted position or in an extended position. In the fully locked position, retaining pins 403 and 440 are respectively aligned in recesses 406 and 446. Note that, optionally, recesses 446 are not provided and the pins 440 are retracted within arms 404 even in the "handle locked" position of FIG. 7. Recesses 446 and their magnets are only provided when desiring to provide extra strength to the handle structure in the retracted and locked position. Pin locking magnets 408 are attracted to locking magnets 409 with optional recess magnet 459 attracted to pin magnet 458.

In operation, cables 410 and 460 withdraw the pins 403 and 440 from respective recesses 406 and 446 when actuator 402 is depressed. When the handle 401 is fully extended, pins 440 are aligned with upper recesses 406 and the attraction of magnets 446 to magnets 409 draws pins 440 into recesses 406, locking the handle in the extended position. Thus, the user may safely lift the container with the handle in the extended position without having to move the handle to a retracted position in order to distribute the load from the handle to a container structural element.

In another aspect, the present invention provides an organizing system for containers such as suitcases for managing personal belonging upon arrival at a destination as well as providing maximum packing flexibility. In particular, the inventive system uses at least a portion of the container/suitcase itself as the support structure for an integrated organization system. Further, the system is at least partially self-assembling; that is, shelves for holding clothes and other personal belongings reposition from a folded state to an open state automatically or semi-automatically with minimal effort by the user. The system may be used in connection with the load-bearing handle system above or independent of the load-bearing handle system.

Figure 8:
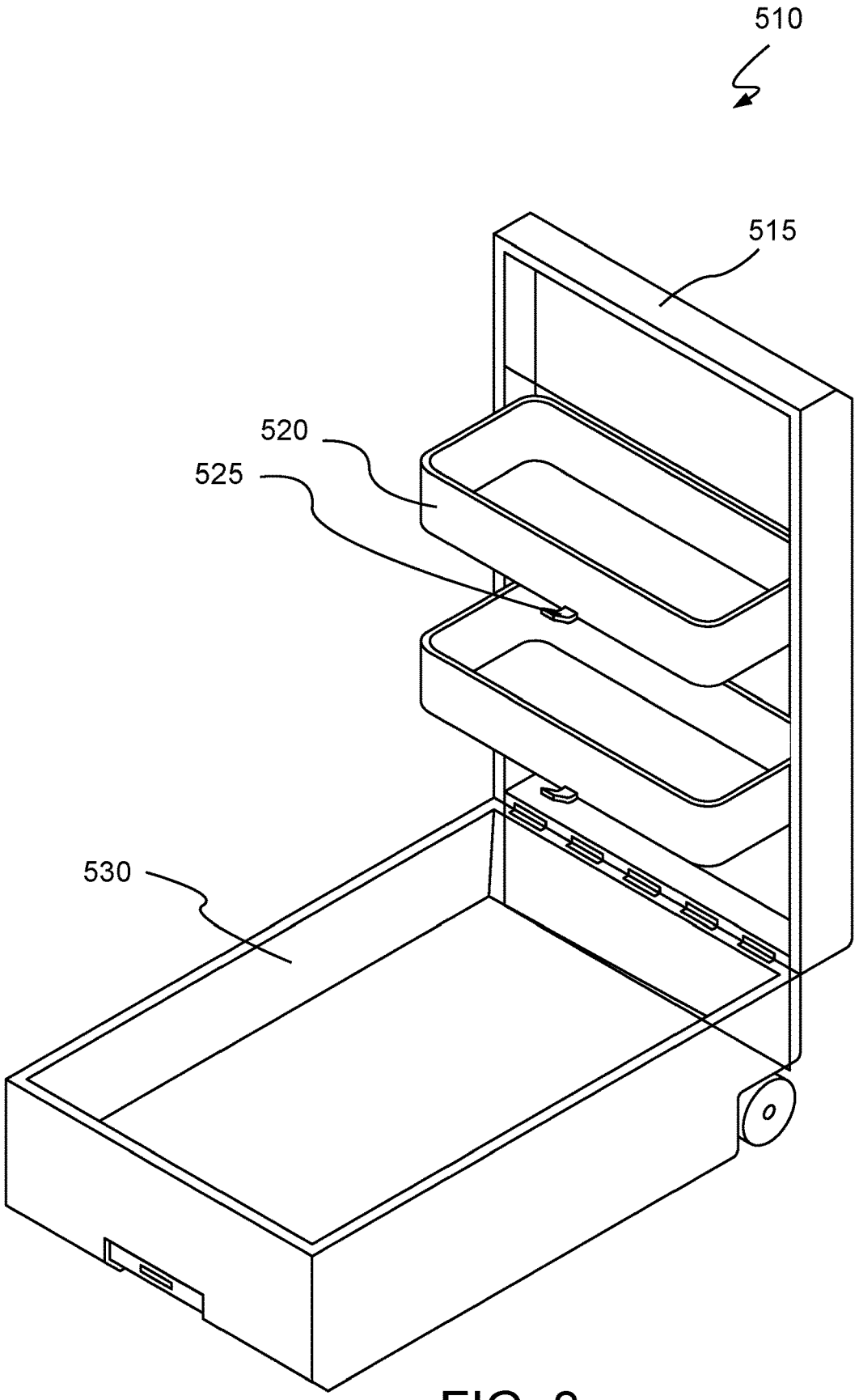
FIG. 8 is a perspective view of an open container/suitcase with an open panel fixed in the vertical position that functions as a supporting structure for self-assembling foldable or attachable or otherwise deployable horizontal shelves in accordance with an embodiment of the present invention.

FIG. 8 depicts a suitcase 510 having a storage portion 530 and a cover portion 515. Cover portion 515 typically attached to storage portion 530 by a zipper, snaps, or hook and loop fasteners (e.g., VELCRO) or a combination thereof. Cover portion 515 and/or storage portion 530 may include frame members, not visible in the drawings, to maintain the rigidity and structural integrity of the suitcase. For example, a rigid metal or plastic frame may have a fabric cover to produce a lightweight suitcase. Alternatively, cover 515 and storage portion 530 may be hard-shell luggage elements, made from a rigid plastic material such as polycarbonate or acrylonitrile butadiene styrene (ABS) or combinations thereof.

Affixed to the cover portion 515 of the suitcase 510 are one or more shelves 520, displayed in FIG. 8 in an open, assembled position. The shelves may be rigid or collapsible; in one embodiment, the shelves may include a metal or plastic wire frame with fabric covering the frame. A rigid plastic plate may be included in a bottom portion of the shelves. A fabric or elastomeric hinge may connect the shelves to the cover portion 515 of the suitcase 10. Alternatively, the shelves may be removable from the cover portion 515 and include an attaching member such as a zipper, hook and loop fastener, snaps, or other known attachments.

An optional closing member, 525, for example, a hook and loop fastener such as VELCRO, may maintain the shelves 520 in a closed position. Alternatively, the shelves may open automatically as the cover of the suitcase is opened. In either embodiment, the user is not required to configure the shelves as the shelves self-assemble to an open position either through the action of opening cover portion 515 or the un-latching of closing member 525. By using closing member 525, when the shelves 520 are not needed, they can be stored away without occupying any space; alternatively, they may be removed in order not to restrict the user in the number ways the luggage can be packed.

To maintain the portion of the suitcase having the shelves attached thereto in an open position, a locking mechanism may be provided, optionally using one or more suitcase wheels as an anchor. For example, the base may include a friction-fitting receiving element that locks into a wheel to hold the cover portion of the suitcase in an open position.

In the embodiment of FIG. 8, the rigidity of the cover member 515 is sufficient to support the weight of shelves 520 and any articles of clothing placed thereon. Although shelves 520 are depicted with an edge portion, it is understood that they may be fully open (e.g., flat plates) or may be optionally closed pouches including zippered closures (or other fasteners such as snaps, hook and loop, or buttons). In this manner, an enclosed shelf may be provided to contain soiled laundry. The shelves 520 may use the entire area of the cover member 515 or a smaller area of cover member 515.

Figure 9:
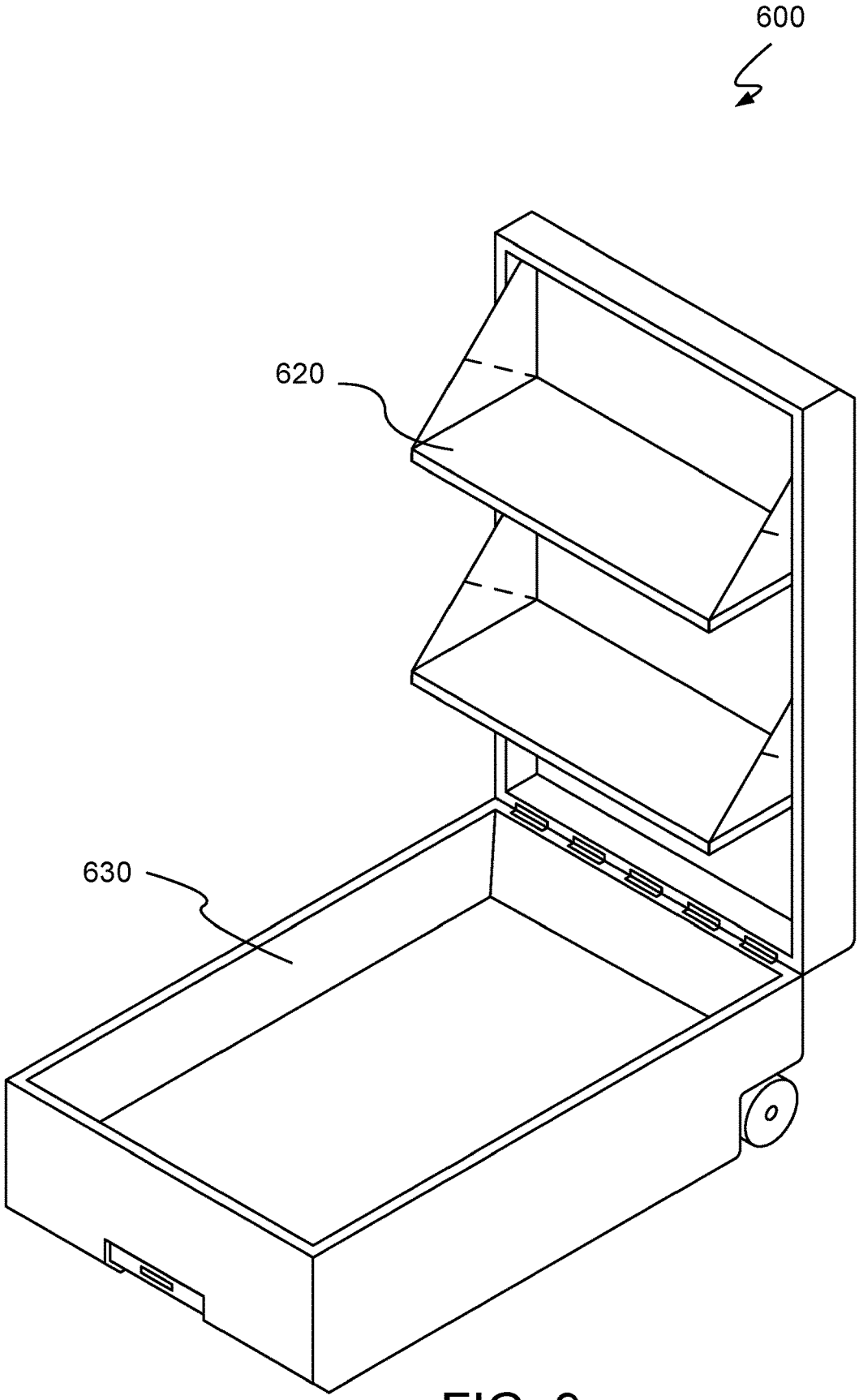
FIG. 9 is a perspective view of an open suitcase with an open panel fixed in the vertical position that functions as a supporting structure for the unfolded, self-assembling shelves in accordance with an embodiment of the present invention.
Figure 10:
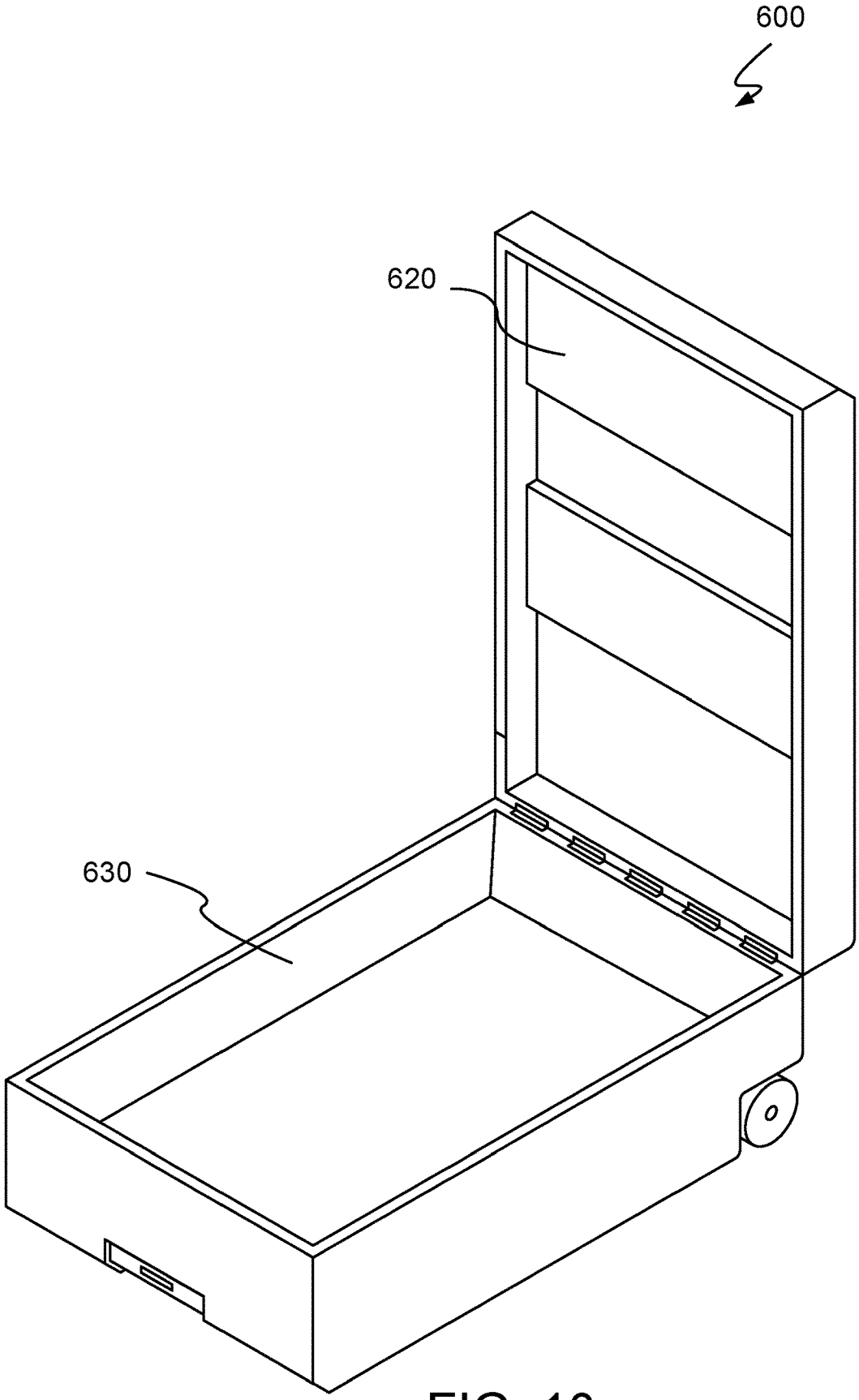
FIG. 10 is a perspective view of an open suitcase with the open panel fixed in the vertical position that functions as a supporting structure for the folded horizontal shelves in accordance with an embodiment of the present invention.

FIG. 10 depicts alternative shelves 620 that are foldable to a relatively flat configuration. Shelves 620 may optionally be maintained in a folded position by fasteners, such as those described above. The shelves, in the folded position, may occupy little to no space within the suitcase 600 if items are not packed within the shelves. In FIG. 9, the shelves 620 have been released to unfold/self-assemble or, alternatively, have unfolded with the action of opening the cover portion 615. The shelves may have a flexible or rigid metal or plastic frame covered by fabric, mesh, or thin sheets of plastic. Optionally, rigid reinforcing base plates may be provided.

Figure 11:
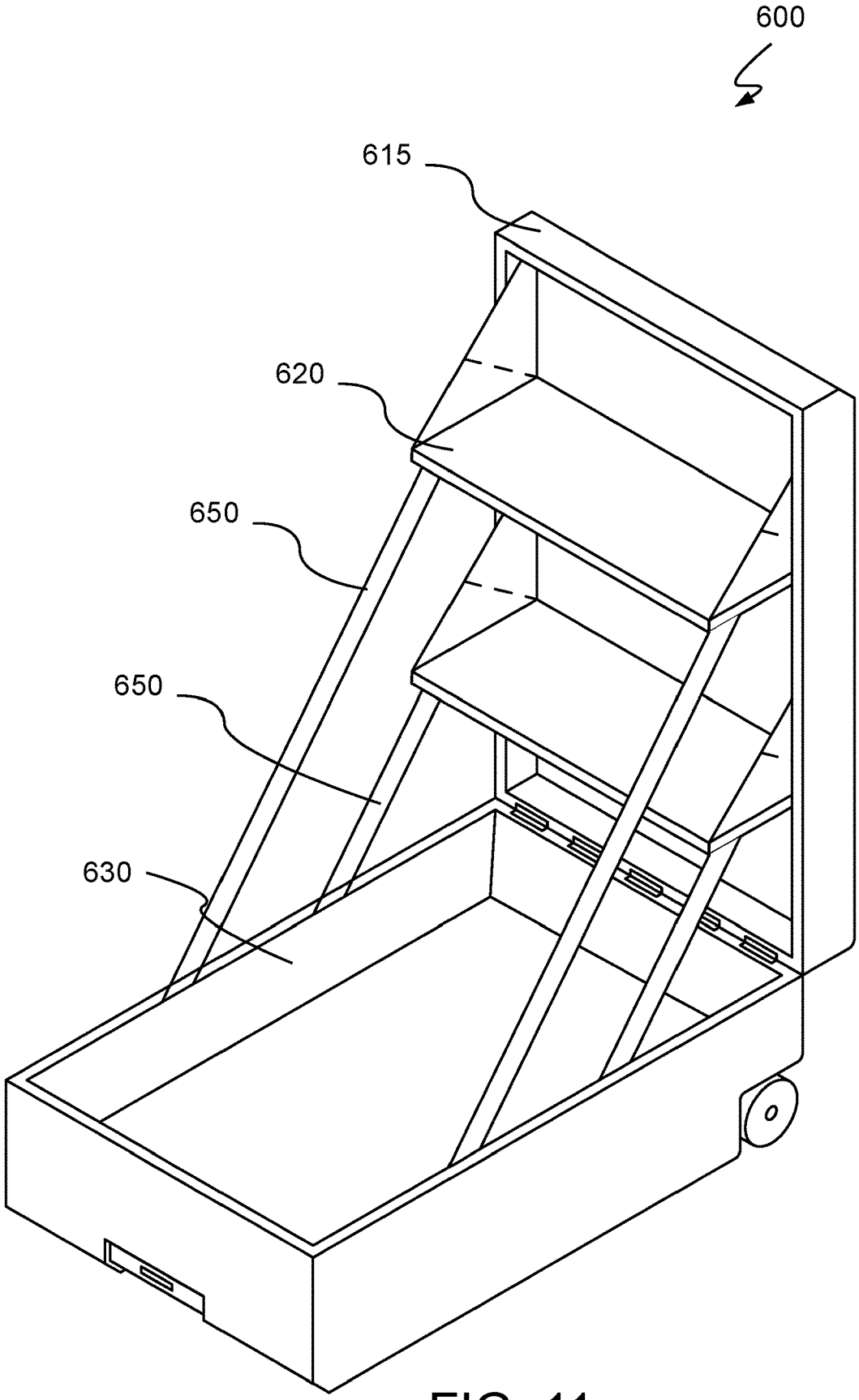
FIG. 11 is a perspective view of an open suitcase with the open panel fixed in the vertical position that functions as a supporting structure for the unfolded horizontal shelves and a limiting member in accordance with an embodiment of the present invention.

A further embodiment of the organizing system is depicted in FIG. 11. In FIG. 11, container/suitcase 600 includes a cover portion 615, a storage portion 630 and a limiting member 650. The limiting member is removably attached between the cover portion 615 and the storage portion 630 to limit the opening of the cover portion. The limiting member may be fabric, web material, elastomeric or partially elastomeric. In some embodiments, it may be selected to be a rigid member such as a rigid plastic or metal rod. In this manner, the cover portion 615 is maintained in a substantially vertical position to be the vertical support member for the shelves.

Depending on the size and configuration of the shelves, the shelves may be used as compartments for holding clothing or toiletries during packing of the suitcase. In such an embodiment, closures are provided through fasteners. Upon releasing the fasteners, the clothing is pre-arranged on the shelves 620, eliminating the need for the user to unpack the container/suitcase.

It should be apparent to those skilled in the art that many modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "includes", "including", "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A handle structure for a container or folding structure comprising a handle with an actuator, a movable retaining pin, an extendable and retractable arm and a handle seat cooperating with a structural part of the container and with a recess; wherein the retaining pin is retracted within the handle by a fastening member;

wherein the fastening member includes a pin locking magnet for cooperating with a recess locking magnet in the recess; and a pin retracting magnet for cooperating with a handle retracting magnet;

the handle structure configured such that the handle in a retracted position, has the retaining pin and the recess aligned;

the pin locking magnet is configured to be drawn to the locking magnet;

and the attraction between the pin locking magnet and locking magnet is configured to be stronger than the attraction between the pin retracting magnet and the handle retracting magnet such that the retaining pin is configured to: automatically move outwards into the hollow recesses; and latch the handle to the handle seat to obstruct any extracting movement of the handle and transfer the loadbearing forces from the handle to the handle seat.

2. The handle structure of claim 1, further comprising a cable positioned between the retaining pin and the actuator, wherein the actuator is configured to retract the retaining pin back into the handle by the cable and move the pin with the pin retracting magnet towards the handle retracting magnet when the actuator is pressed such that the handle is free to move out of the handle seat from the retracted position to an extended position.

3. The handle structure of claim 2, wherein the extendable and retractable arms include telescoping members that telescope within each other to shorten the length that is stored within the container to which the handle is attached.

4. The handle structure of claim 3, wherein telescoping members are cylindrical or rectangular concentric tubes.

5. The handle structure of claim 1, wherein the actuator is a push button and includes one or more springs.

6. The handle structure of claim 1, further comprising a second retaining pin positioned within the extendable and retractable arm, the second retaining pin including a second pin locking magnet for cooperating with the recess locking magnet of the recess such that when the handle is in an extended position, the second retaining pin is attracted to the recess locking magnet to lock the second retaining pin within the recess.

7. The handle structure of claim 1, wherein the container is a suitcase.

8. The handle structure of claim 7, wherein the first actuator is a depressible push button.

9. The handle structure of claim 7, wherein the extendable and retractable arm includes telescoping members that telescope within each other to shorten the length that is stored within the container to which the handle is attached.

10. A suitcase including the handle structure of claim 1.

11. The handle structure of claim 1, wherein the first and second actuators include springs.

12. A suitcase including the handle structure of claim 1, and further comprising:

a storage portion;

a cover portion attached to the storage portion;

one or more shelves extending from the cover portion.

13. The suitcase of claim 12, wherein the one or more shelves are collapsible, folding shelves.

14. The suitcase of claim 13, wherein the shelves are self-opening when the cover portion is opened.

15. A handle structure for a container comprising:

a handle with a first actuator;

a movable retaining pin positioned within the handle;

an extendable and retractable arm connected to the handle;

a handle seat integrated with and forming a structural part of a container, the handle seat including a hollow recess for receiving the movable retaining pin, the moveable retaining pin being movable between a position within the handle and a position within the hollow recess to lock the handle in a load-bearing position;

the handle structure configured such that the handle in a retracted position, has the retaining pin and the hollow recess aligned;

a second actuator cooperating with the first actuator to move the retaining pin from the position within the handle to the position within the hollow recess and to retract the retaining pin from the position within the hollow recess to the position within the handle to permit the handle to extend via the extendable and retractable arm connected to the handle.

16. A suitcase including the handle structure of claim 15, and further comprising:

a storage portion;

a cover portion attached to the storage portion;

one or more shelves extending from the cover portion.

17. The suitcase of claim 16, wherein the one or more shelves are collapsible, folding shelves.

18. The suitcase of claim 17, wherein the shelves are self-opening when the cover portion is opened.

* * * * *